United States Patent [19]

Van Ijzeren

[11] 4,182,974

[45] Jan. 8, 1980

[54] GETTER CONNECTED TO CATHODE RAY TUBE HIGH VOLTAGE CONTACT

[75] Inventor: Anton J. Van Ijzeren, Eindhoven, Netherlands

[73] Assignee: U.S. Philips Corporation, New York, N.Y.

[21] Appl. No.: 892,115

[22] Filed: Mar. 31, 1978

[30] Foreign Application Priority Data

Apr. 6, 1977 [NL] Netherlands ..... 7703759

[51] Int. Cl.[2] ..... H01J 29/84; H01J 31/00

[52] U.S. Cl. ..... 313/481; 313/482

[58] Field of Search ..... 313/481, 406, 404, 407, 313/405, 178 (U.S. only)

[56] References Cited

U.S. PATENT DOCUMENTS 2,922,063 1/1960 Haas ..... 313/406

FOREIGN PATENT DOCUMENTS 1226728 5/1969 United Kingdom ..... 313/481

*Primary Examiner*—Robert Segal

*Attorney, Agent, or Firm*—Algy Tamoshunas

[57] ABSTRACT

Disclosed is a picture display tube comprising an envelope having a display window, a cone and a neck. An electrode system to generate at least one electron beam is mounted in the neck and an electrical resistive layer extends over an internal wall portion of the envelope to a point near the electrode system. The tube comprises a getter which is detachably secured to a connecting member projecting internally from the wall of the tube at a location remote from the electrode system by means of a resilient connection strip. The portion of the connection member projecting from the tube wall has a gradually widening end having a largest transverse dimension D and a smallest transverse dimension d and the connection strip of the getter has a first aperture whose dimensions are larger than the dimension D. The first aperture debouches via a passage of width b into a second aperture of dimensions A in a manner such that $D>A>b>d$, so that the gradually widening end of the connecting member in cooperation with the said second aperture forms a detachable coupling.

10 Claims, 11 Drawing Figures

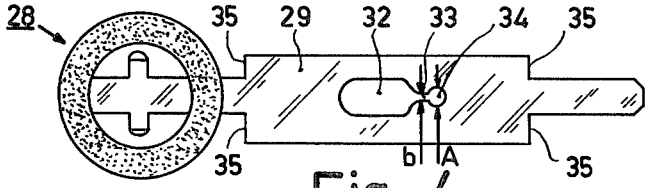
Fig. 4
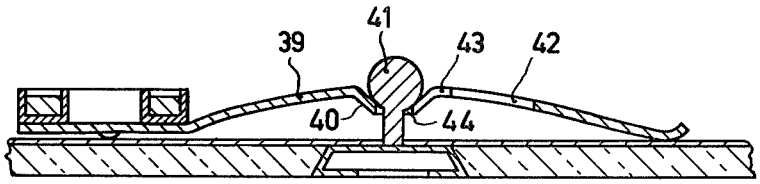
Fig. 5
Fig. 6
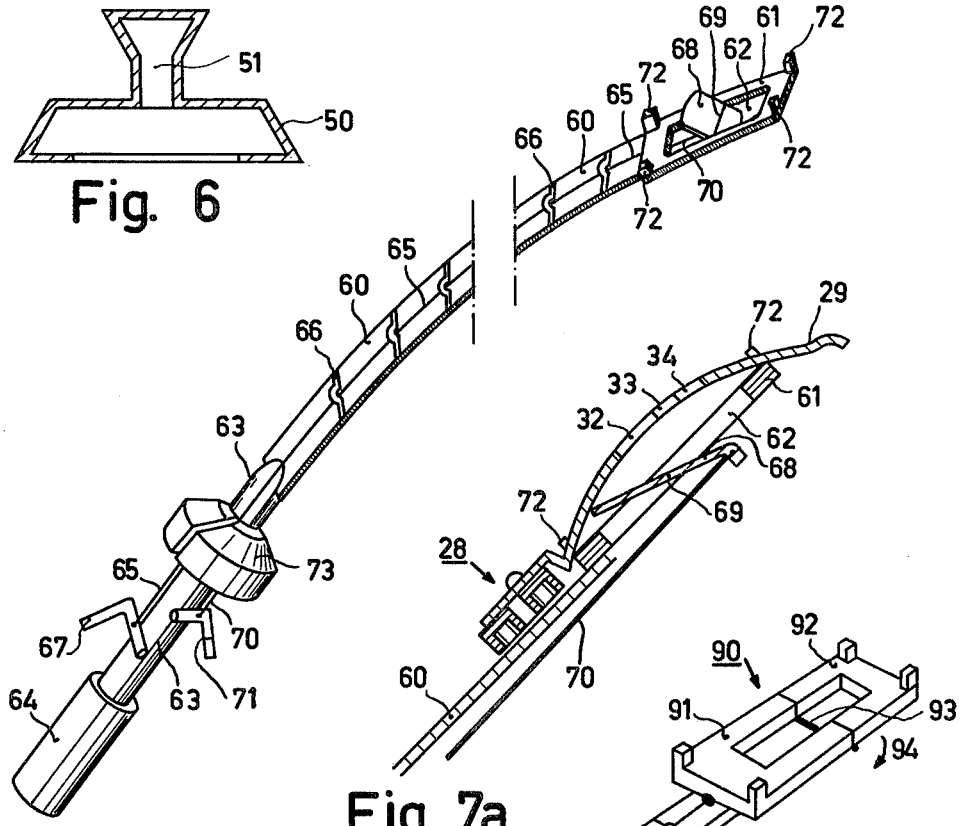
Fig. 7
Fig. 7a
Fig. 7b

GETTER CONNECTED TO CATHODE RAY TUBE HIGH VOLTAGE CONTACT

The invention relates to a picture display tube comprising an envelope including a display screen, an electrode system to generate at least one electron beam directed onto the display screen, an electrically conductive layer which extends at least between the display screen and the electrode system over the inner surface of the envelope. At least the portion of the conductive layer situated near the electrode system is an electrical resistive layer. The tube further comprises a high voltage contact which is provided in the envelope between the display screen and the electrode system and which is electrically connected to the conductive layer, and a getter which is secured to a connection member projecting internally from the tube wall by means of a resilient metal strip.

Such a picture display tube is disclosed in British patent specification No. 1,226,728.

As a result of the large voltage differences between certain electrodes of the electrode system, electrical flashovers in the tube may occur which are associated with currents rising rapidly in time and reaching high values. As a result of this, damage may be done, in particular, to semiconductor components in the electronic circuit of the television receiver via inductive or capacitive coupling. A known solution for avoiding such damage is to provide an electrically resistive layer on an internal wall portion of the tube envelope near the electrode system. The result of this solution, however, is that the getter usually connected to the electrode system by means of a metal strip has to be secured elsewhere in the tube to prevent the gettering material released from the getter by heating from depositing on and shortcircuiting the resistive layer or prevent the layer from being shortcircuited by the metal strip. Thus the getter should be mounted in the tube at a location remote from the electrode system.

Figure 3:
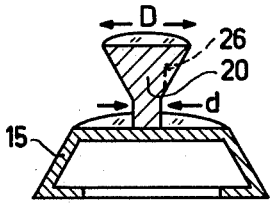

In FIG. 3 of the above-mentioned British patent specification the getter is secured to the high voltage contact. The getter is connected to the contact prior to securing the glass cone to the glass window of the tube. An advantage of this method is that the getter is mounted in the tube during a phase of the manufacturing process of the tube when the location in the tube at which the getter is to be mounted is still readily accessible. The detrimental effects of gases and vapours on the getter during subsequent phases in the manufacturing process can be avoided by using a protective getter or a chemically resistant getter.

The method disclosed in the British patent specification would be satisfactory if there were no need at all for mounting a getter in the tube after the cone and the window are secured to each other as is the case with black-and-white display tubes. However, during manufacture of colour tubes the envelope is stored for some time after the window is secured to the cone. In that case, therefore, it is undesirable to mount the getter at the time the tube envelope is assembled. Furthermore if the tube has to be repaired it has to be provided with a new getter.

It is the object of the invention to provide a picture display tube in which a getter can be introduced through the neck of the tube and in which, in a location remote from the electrode system, the tube is provided with a connection member to which the getter can be easily secured, as well as easily detached.

According to the invention, a picture display tube of the kind mentioned in the preamble is provided with a connecting member which projects from the tube wall. The connecting member has a gradually widening end having a largest transverse dimension D and a smallest transverse dimension d. The getter has a metal connection strip with a first aperture whose dimensions are larger than the largest transverse dimension D. The first aperture debouches via a passage of width b into a second aperture having dimensions A, in a manner such that $D>A>b>d$, so that the gradually widening end of the connection member in cooperation with the second aperture forms a detachable coupling.

The getter is secured by inserting the widening end of the connecting member through the first aperture in the connecting strip and then moving the connection strip in its longitudinal direction in a manner such that the second aperture is made to cooperate with the widening end of the connecting member. The coupling thus produced is locked in that the connection strip bears on the tube wall on either side of the second aperture and, as a result of the resilience in the strip, the strip is pressed against the widening end of the connection member at the area of the second aperture. It has been found that a good coupling between the connection member and the connection strip is obtained even with low resilience of the strip. Hence no large resilient forces need be overcome for producing the coupling. As a result of this, the auxiliary tool for mounting the getter can be of an extremely simple construction and minimizing the possibility of damage to the tube during mounting of the getter. The removal of the getter during repair of the tube can also be carried out in an extremely simple manner and without exerting great forces with the coupling mechanism of the invention.

The gradually widening end of the connection member may have several shapes. The end preferably is in the form of a sphere, a cone or a pyramid. In a further embodiment according to the invention the connection strip has a deepened portion or an indentation at the region of the second aperture so that an extra locking of the coupling is obtained. The shape of the indentation may correspond to the shape of the gradually widening end of the connection member.

In the latter arrangement and with a connection member widening in the form of a pyramid, the strip may also be locked against rotation with respect to the connection member. Locking against rotation is alternatively possible by providing the widening end of the connection member with at least one flattened portion which cooperates with a straight edge of the second aperture.

The connection member is preferably secured to the high voltage contact provided in the tube wall so that with the insertion of the high voltage contact the connection member for the getter is also obtained. According to a further embodiment of the invention the connection member with the high voltage contact constitutes one assembly of sheet material.

Figure 1:
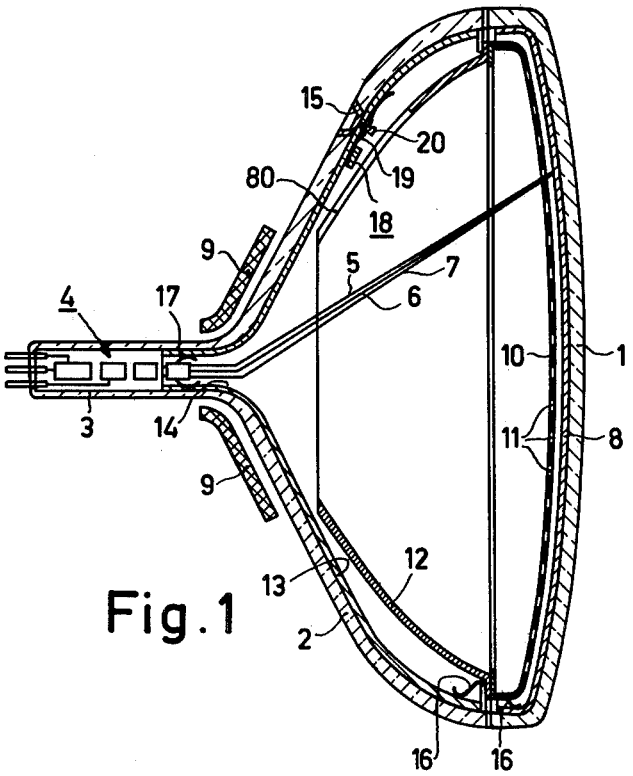
Figure 2:
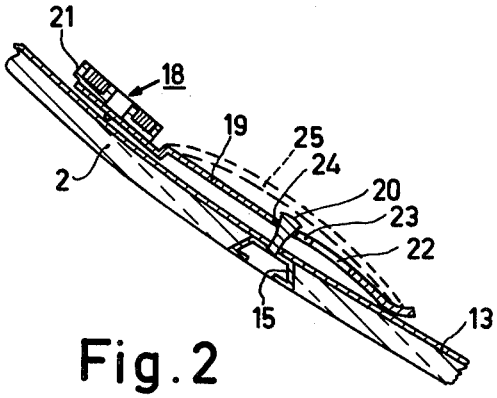

The invention will now be described in greater detail with reference to the drawing in which:

FIG. 1 is a sectional view of a colour television display tube with a getter according to the invention, FIG. 2 shows on an enlarged scale the manner in which the getter is secured in the display tube shown in FIG. 1, FIGS. 3, 3A and 3B are sectional views of embodiments of a connection member according to the invention secured to the high voltage contact, FIG. 4 is a plan view of a getter having a connection strip according to the invention, FIG. 5 is a sectional view of an embodiment of a connection construction according to the invention, FIG. 6 is a sectional view of a connecting member forming one assembly with the high voltage contact, and FIGS. 7, 7A and 7B show an auxiliary tool for mounting a getter according to the invention in the tube.

The tube, shown in FIG. 1 in a vertical sectional view, comprises a glass envelope having a display window 1, a cone 2 and a neck 3. An electrode system 4 for generating three electron beams 5, 6 and 7 is mounted in the neck 3. The electron beams 5, 6 and 7 are generated in one plane, in this case normal to the plane of the drawing, and are directed onto a display screen 8 provided internally on the display window 1 and consisting of a large number of phosphor strips luminescing in red, green and blue whose longitudinal direction is parallel to the plane of the drawing. On their way to the display screen 8, the electron beams 5, 6 and 7 are deflected over the display screen 8 by means of a number of deflection coils 9 arranged coaxially around the tube axis and pass through a colour selection electrode 10 consisting of a metal plate having elongate apertures 11 whose longitudinal direction is also parallel to the plane of the drawing. The three electron beams 5, 6 and 7 pass through the apertures 11 at a small angle to each other and consequently each impinges only upon phosphor strips of one colour. The tube furthermore comprises an inner screening cone 12 screens which the electron beams 5, 6 and 7 from the earth's magnetic field. The inner wall of the tube is coated with an electrically conductive layer 13 with a portion 14 extending from the neck-cone transition in the neck 3 consisting of an electrically resistive material which is composed of a mixture of approximately 6 parts by weight of ferric oxide and 1 part by weight of graphite and 2.5 parts by weight of potassium silicate. The layer 13, which may alternatively consist of an electrically resistive layer, is connected to a high voltage contact 15 provided in the tube wall and is further connected, via contact springs 16, to the colour selection electrode 10 and the display screen 8 and, via contact springs 17, to the last electrode of the electrode system 4.

As is known, after evacuation of the tube a layer of gettering material of, for example, barium, strontium, calcium or magnesium is deposited on the tube wall so as to getter the residual gases remained in the tube. In conventional display tubes, the gettering device from which the gettering material is released by heating, is connected to the electrode system either directly or by means of a metal strip. As already stated, this conventional mounting arrangement cannot be used in a display tube having a resistive layer. As shown in FIG. 1, according to the invention, the getter 18 is mounted in the tube by means of a connection strip 19 at a location remote from the electrode system 4. The getter is detachably secured to a connection member welded to the high voltage contact 15 by using a mounting arrangement described hereinafter with reference to FIG. 2. This figure shows the wall portion of the cone 2 in which the high voltage contact 15 is sealed. The high voltage contact 15 has a connection member which extends into the tube cavity and which is in the form of a pin 20 which at its free end widens in the form of a cone and has a largest transverse dimension D and a smallest transverse dimension d, as shown in FIG. 3. As shown in FIG. 2 the getter 18 comprises a metal holder 21 which is welded to the metal connection strip 19. The strip 19 has a first aperture 22 whose dimensions are larger than the transverse dimension D. The aperture 22 communicates via a passage 23 with a second aperture 24 which is smaller than the transverse dimension D but is larger than the transverse dimension d. The width of the passage 23 is slightly larger than the dimension d but is smaller than the aperture 24. This is illustrated in the plan view in FIG. 4 of a getter 28 and a connection strip 29. The strip has a first aperture 32, a passage 33 and a second aperture 34. Due to the resilience of the connection strip 19, which is pre-bent according to the broken lines 25, (shown in FIG. 2), the strip 19 presses against the conically widening end of the pin 20 at the area of the second aperture 24 with which the coupling of the strip 19 and the pin 20 is produced. Possible rotation of the strip 19 about the pin 20 can be prevented, for example, by providing the widening end of the pin 20 with at least one flattened portion as shown in FIG. 3 by the broken line 26 and providing the second aperture 24 with a straight edge cooperating with the flattened portion.

Figure 3B:
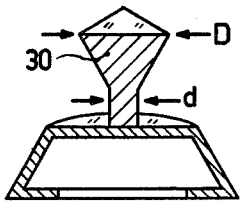
Figure 3A:
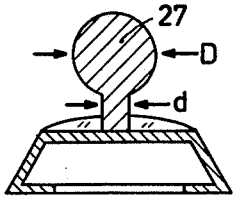

Instead of a conically widening end, other shapes are also possible, for example, the spherically widening end 27 of the connection member shown in FIG. 3A, or the end 30 widening in the form of a pyramid as shown in FIG. 3B. Furthermore it is not necessary to secure the connection member to the high voltage contact. The connection member may also be inserted independently in the tube wall.

FIG. 5 shows a getter structure in which the connection strip 39 has an indentation 40 at the region of the second aperture 44. As a result of this, the coupling between the connection strip 39 and the connection member 41 is additionally locked. Otherwise, the strip 39 again has a first aperture 42 which debouches via a passage 43 into the second aperture 44, analogously to the construction shown in FIG. 4.

FIG. 6 shows a high voltage contact 50 having a connection member 51 integral therewith. The assembly is manufactured from sheet material and obtained by deep drawing. This construction which has been manufactured from one piece has the advantage that no welding operation need be carried out which might damage the high voltage contact.

FIG. 7 shows a possible embodiment of a device for inserting the getter through the neck of the tube and mounting it in the tube. The device comprises a resilient metal strip 60 which at one end has a metal holder 61 provided with an elongated aperture 62. The other end of the strip 60 is secured to a rigid tube 63 having a handle 64. A pull cable 65 connected at one end to the holder 61 is guided along the strip 60 by means of cable guides 66 and at the other end is attached to a handle 67 rotatably secured to the tube 63. The resilient strip 60 is bent by tensioning the cable 65 by means of the handle 67. A stud 68 is rotatably arranged about a shaft 69 in the aperture 62 of the holder 61. A second pull cable 70, which is also guided along the strip 60 with a small amount of play is rotatably secured at one end to a second handle 71 connected to the tube 63 and is secured to the stud 68 at its other end. By tensioning the pull cable 70 by means of the handle 71, the stud 68 rotates about the shaft 69 releasing a getter secured to the holder 61.

FIG. 7A shows the getter 28 of FIG. 4 with connection strip 29 in a position in which it is mounted on the holder 61. The connection strip 29 has four abutment edges 35 with which the strip 29 can be tensioned between four studs 72 on the holder 61. In the position shown in FIG. 7A, the getter 28 can be positioned in its place via the still open neck 3 of the tube shown in FIG. 1. This is done as follows. The resilient strip 60 of the getter insertion apparatus shown in FIG. 7 is inserted into the neck 3 of the tube a distance such that the abutment member 73 bears against the open end of the tube neck 3. The pull cable 65 is then tensioned so that the strip 60 bends and the holder 61 is moved towards the high voltage contact 15 with the connection member 20. Access to the high voltage contact is provided via a slot-shaped recess 80 in the magnetic screening cone 12, as shown in FIG. 1. The location of the abutment number 73 on the insertion apparatus is such that in the bent condition of the strip 60, the aperture 32 provided in the connection strip 29 corresponds to the location of the connection member 20 so that, when the strip 60 is bent, the connection strip 29 slides over the widening end of the connection member 20. The strip 29 is then moved in its longitudinal direction until the second aperture 34 coincides with the connection member 20. In this phase of the method, the connection strip 29 is detached from the holder 61 by tensioning the cable 70 so that the stud 68 rotates and the connection strip 29 is pressed between the studs 72. Due to the resilience of the connection strip 29, the strip presses against the gradually widening end of the connection member 20 at the area of the aperture 34. Thus the coupling of the strip 29 and the connection member 20 is produced in the manner as shown in FIG. 2 or FIG. 5.

The principle of inserting and securing a getter in the tube has been explained with reference to a manually operated apparatus. Of course, the operation of the apparatus can be mechanized. Detaching the connection strip of the getter from the holder can furthermore be realised in ways differing from that with the stud 68. For example, as shown in FIG. 7B, the holder 90 may consist of two portions 91 and 92 pivoting about a shaft 83. To detach the connection strip of the getter, the part 92 of the holder 90 is tilted in the direction of the arrow 94. According to another possibility, the holder can be made detachable by a construction in which the parts 91 and 92 are drawn apart in the longitudinal direction of the holder.

What is claimed is:

1. A display tube comprising an envelope having a conical portion terminating in a generally cylindrical neck and a window portion secured to the end of said conical portion opposite said neck and having a display screen on the inner surface thereof, an electrode system positioned in said neck for generating at least one electron beam directed onto said display screen, an electrically conductive layer extending between said display screen and said electrode system over the inner surface of said conical portion, at least a portion of said layer near said electrode system being an electrical resistive layer and electrically connected to the conductive layer, a high voltage contact provided in said conical portion between said window portion and said electrode system, a getter and means for detachably mounting, in said envelope, said getter inserted into said conical portion through said neck after said window portion is secured to said conical portion and prior to positioning said electrode system in said neck, said mounting means including a connecting member affixed to a wall of said conical portion and projecting into the interior of said envelope, said connecting member having a gradually widening end with a largest transverse dimension D and a smallest transverse dimension d, and a resilient metal strip affixed to said getter, said strip having a first aperture of a dimension larger than said dimension D, a second aperture of dimension A, and an opening of width b extending between said first and second apertures in a manner such that $D>A>b>d$, so that said end of said connecting member in cooperation with said second aperture form a coupling for detachably mounting said getter in said envelope.

2. A picture display tube as claimed in claim 1, wherein the portion of the connecting member projecting from the tube wall widens conically.

3. A picture display tube as claimed in claim 1, wherein the portion of the connecting member projecting from the tube wall widens spherically.

4. A picture display tube as claimed in claim 1, wherein the portion of the connecting member projecting from the tube wall widens in the form of a pyramid.

5. A picture display tube as claimed in claim 1 wherein said metal strip affixed to the getter has an indentation at the region of the second aperture.

6. A picture display tube as claimed in claim 5 wherein the shape of said indentation corresponds to the shape of the gradually widening end of the connecting member.

7. A picture display tube as claimed in claim 1, wherein the connection strip of the getter is locked against rotation with respect to the connecting member.

8. A picture display tube as claimed in claim 1 wherein the connecting member is secured to the high voltage contact.

9. A picture display tube as claimed in claim 8 wherein the connecting member and the high voltage contact are integral and are made from sheet material.

10. A device for connecting a getter in a picture display tube in which the getter is inserted via the tube neck and is secured so as to be detachable to a connection member projecting internally from the tube wall by means of a resilient connection strip, characterized in that the device comprises a strip of resilient material which at one end is secured to a rigid member and at the other end has a holder on which a number of studs are present between which the connection strip of the getter can be clamped temporarily and which holder comprises means to detach the connection strip from the holder, which device has an abutment limiting the depth of insertion of the strip in the tube and furthermore has a cable which is guided along the strip and is secured near the holder to bend the strip and thus to transport the getter which is temporarily secured to the holder towards the connection member projecting internally from the tube wall.

* * * * *

UNITED STATES PATENT AND TRADEMARK OFFICE

CERTIFICATE OF CORRECTION

PATENT NO. : 4,182,974

DATED : January 8, 1980

INVENTOR(S) : ANTON JAN VAN IJZEREN

It is certified that error appears in the above-identified patent and that said Letters Patent are hereby corrected as shown below:

Col. 5, line 64, delete "and electrically connected to the conductive"

Col. 6, line 1, delete "layer"

line 3, after "system" insert --and electrically connected to said conductive layer--.

Signed and Sealed this

*Thirteenth* Day of *May 1980*

[SEAL]

*Attest:*

SIDNEY A. DIAMOND

*Attesting Officer*

*Commissioner of Patents and Trademarks*